US010221577B1

(12) United States Patent
Westcott

(10) Patent No.: US 10,221,577 B1
(45) Date of Patent: Mar. 5, 2019

(54) VINYL SIDING REMOVAL AND INSTALLATION TOOL

(71) Applicant: Luke M. Westcott, Fort Pierce, FL (US)

(72) Inventor: Luke M. Westcott, Fort Pierce, FL (US)

( * ) Notice: Subject to any disclaimer, the term of this patent is extended or adjusted under 35 U.S.C. 154(b) by 609 days.

(21) Appl. No.: 14/679,560

(22) Filed: Apr. 6, 2015

Related U.S. Application Data

(60) Provisional application No. 62/023,572, filed on Jul. 11, 2014.

(51) Int. Cl.
*E04F 21/18* (2006.01)
*B25B 27/00* (2006.01)
*B25B 15/00* (2006.01)

(52) U.S. Cl.
CPC ..... *E04F 21/1855* (2013.01); *B25B 15/008* (2013.01); *B25B 27/0028* (2013.01); *B25B 27/0035* (2013.01)

(58) Field of Classification Search
CPC .... E04F 21/1855; B25B 15/008; B25B 23/16; Y10T 29/49815; Y10T 29/49822; Y10T 29/49821; Y10T 29/49824
USPC .... 81/45, 177.1, 488, 9.2; 29/238, 239, 244; 254/21, 19, 25
See application file for complete search history.

(56) References Cited

U.S. PATENT DOCUMENTS 2,605,665 A * 8/1952 Grenat ..... B25F 1/00 72/458
4,596,167 A * 6/1986 White, Jr. ..... B25G 1/043 81/177.2
5,075,945 A * 12/1991 Krzecki ..... B25B 27/0028 29/235
5,140,877 A * 8/1992 Sloan ..... B25B 13/481 81/436
5,592,859 A * 1/1997 Johnson ..... B25B 13/56 81/177.2
5,931,066 A * 8/1999 Waynick ..... B25B 13/04 81/119
6,332,381 B1 * 12/2001 Vasudeva ..... B25B 15/008 81/177.1

(Continued)

FOREIGN PATENT DOCUMENTS

DE 202014002159 U1 * 6/2014 ..... B25B 13/481

*Primary Examiner* — Christopher M Koehler
*Assistant Examiner* — Seahee Yoon
(74) *Attorney, Agent, or Firm* — Williams Intellectual Property; Benjamin F. Williams

(57) ABSTRACT

A vinyl siding removal and installation tool including an elongate, wirelike anterior projection having a hooked end, said hooked end having a ball tip endwise thereon proximal a groove-cut circumferentially disposed upon the hooked end, wherein the hooked end is fittable into any weep hole upon a section of vinyl siding to effect decoupling of a folded seam whereby said section of vinyl siding is unlockable from an adjacent section of vinyl siding and wherein the hooked end is fittable hooked into the folded seam of an unlocked section of vinyl siding to effect relocking of said folded seam to an adjacent section of vinyl siding by rotational action of the hooked end to reseat the folded seam proximal said hooked end, whereby sliding action of the hooked end along the length of the folded seam effects relocking of said folded seam along the length of said folded seam.

9 Claims, 3 Drawing Sheets

(56) References Cited

U.S. PATENT DOCUMENTS

| | | | | |
|---|---|---|---|---|
| 6,499,778 | B2 * | 12/2002 | Boulay | B25B 9/00 254/134.3 R |
| 6,807,699 | B2 * | 10/2004 | Michelman | B25B 15/007 227/63 |
| 6,833,034 | B1 * | 12/2004 | Thomas, Jr. | A47L 13/10 134/6 |
| 8,544,916 | B2 * | 10/2013 | Acquah | H02G 1/10 114/221 R |
| 2002/0108473 | A1 * | 8/2002 | Warner | B25B 15/008 81/440 |
| 2007/0018467 | A1 * | 1/2007 | Schwartz | A47F 13/06 294/210 |
| 2013/0160617 | A1 * | 6/2013 | Hsieh | B25B 23/1427 81/467 |

* cited by examiner

VINYL SIDING REMOVAL AND INSTALLATION TOOL

CROSS-REFERENCE TO RELATED APPLICATIONS

This nonprovisional application claims the benefit of provisional application No. 62/023,572 filed on Jul. 11, 2014.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of vinyl siding tools are known in the prior art. Most require awkward manipulation to fit in between sections of vinyl siding to thence force decoupling of a folded seam of one section of vinyl siding engaged into an adjacent section of vinyl siding. Some such preexisting tools use a flattened spatula to wrestle in between said sections of vinyl siding, requiring exertion and finesse and repeated action.

What is needed is a vinyl siding removal and installation tool that includes an elongate wirelike anterior projection having a hooked end fittable into any weep hole disposed along an edge of a section of vinyl siding to hook to and engage around a folded seam, whereby pulling upon the tool thence effects decoupling of the folded seam for expedient unlocking of one section of vinyl siding lengthwise from an adjacent other section of vinyl siding, said hooked end likewise hookable into the folded seam of an uncoupled section of vinyl siding, wherein rotation of the hooked end effects reseating of the folded seam engaged into an adjacent section of vinyl siding and sliding action of the hooked end along said seam thence effects relocking of the section of vinyl siding lengthwise to an adjacent section of vinyl siding, whereby expedient removal and installation of vinyl siding is readily effected with less effort required than is otherwise expendible using current tools available on the market today.

FIELD OF THE INVENTION

The present invention relates to a vinyl siding removal and installation tool, and more particularly, to a vinyl siding removal and installation tool having an elongate, wirelike anterior projection disposed anteriorly upon a rubberlike handle, said elongate wirelike anterior projection having a hooked end disposed for insertion into any weep hole evident along a section of vinyl siding, said hooked end thence engageable around a folded seam of said section of vinyl siding, whereby pulling upon the handle effects decoupling the folded seam from engagement with an adjacent section of vinyl siding and a user is enabled unlocking of said folded seam for removal of said section of vinyl siding, and which hooked end is likewise fittable into the folded seam of an unlocked section of vinyl siding, whereby action of rotation of the hooked end there disposed effects reseating of the folded seam engaged to an adjacent section of vinyl siding and subsequently sliding the hooked end along the length of the folded seam reseats said seam to the adjacent section of vinyl siding to relock the section of vinyl siding in place, whereby expeditious removal and installation of vinyl siding is effective with less effort required than is otherwise expended by use of current tools available on the market today.

SUMMARY OF THE INVENTION

The general purpose of the vinyl siding removal and installation tool, described subsequently in greater detail, is to provide a vinyl siding removal and installation tool which has many novel features that result in a vinyl siding removal and installation tool which is not anticipated, rendered obvious, suggested, or even implied by prior art, either alone or in combination thereof.

The present vinyl siding removal and installation tool has been devised to effect expedient unlocking and locking of a folded seam of a section of vinyl siding to uncouple and recouple said section of vinyl siding from an adjacent section of vinyl siding. The present state of the art requires maneuvering a spatulate or other flattened end-piece in between sections of vinyl siding and thence forcing the folded seam to decouple in repeated actions required along the length of the particular section of vinyl siding. Moreover, there appears no expedient means of extending the reach of tools available in the present state of the art whereby a user aloft a ladder working on siding at height is thereby required to regularly descend and reposition said ladder while working on a single section of vinyl siding.

What is needed is a tool that efficiently effects decoupling of the folded seam engaged by an adjacent section of vinyl siding for expedient unlocking of a section of vinyl siding and, moreover, enables expedient reseating of said folded seam to relock the section of vinyl siding back in position.

The present vinyl siding removal and installation tool, therefore, effects unlocking of a section of vinyl siding by action of an elongate wirelike anterior projection into a weep hole disposed along any section of vinyl siding wherein pulling and rotation of a hooked end inserted therein effects uncoupling of a folded seam of said section of vinyl siding in position proximal the weep hole. The entire section of vinyl siding is thence separable along the folded seam by pulling the section of vinyl siding away from the adjacent section of vinyl siding.

Relocking of the folded seam is effective by position of the hooked end engaged against the folded seam of the uncoupled section of vinyl siding and rotating thereat, whereby the folded seam snaps into engagement with the adjacent section of vinyl siding. The folded seam is thence connectable lengthwise to the adjacent section of vinyl siding by lateral action of the hooked end pulled along the length of the folded seam whereby the folded seam is reseated and relocked to the adjacent section of vinyl siding. Thus recoupling of sections of vinyl siding is expediently effective.

The present vinyl siding removal and installation tool, therefore, includes an elongate wirelike anterior projection disposed anteriorly mounted upon a rubberlike handle. The rubberlike handle is ergonomically configured for grasping in the hand of a user.

The elongate wirelike anterior projection includes a hooked end disposed distally from the handle, said hooked end including a spherical ball tip disposed endwise thereon and a groove-cut circumcised around the hooked end immediately proximal the ball tip. The hooked end is disposed subsequent an angled turn disposed in the elongate wirelike anterior projection such that the ball tip is positioned facing towards a user wielding the tool.

An interconnection ring is disposed basally upon the handle for hooked engagement with a hooked end of a second vinyl siding removal and installation tool, whereby the reach of a user is increased when recoupling sections of vinyl siding. Thus, a user may insert the hooked end of a first vinyl siding removal and installation tool into the folded seam of a section of vinyl siding and snap the seam into seated engagement with an adjacent section of vinyl siding, and thence, by pulling the tool engaged with the folded seam along the length of the seam, reseat the seam along the extent of said user's reach. Once the seam has been reseated along the extent of this user's reach, said user may thence pass the tool to a second user, who may couple a second vinyl siding removal and installation tool by hooked engagement at the interconnection ring, to effectively drag the first vinyl siding removal and installation tool into the extent of said second user's reach, whereby the seam may be relocked between two or more users by passing the first vinyl siding removal and installation tool from one user to the next.

This is particularly useful when working on sections of siding disposed above ground at height whereat use of a ladder is required, as a first user may pass the tool to a second user, for example, thence relocate said first user's ladder for collection of the tool once passed to the extent of said second user's reach, for relayed action of the tool along the extent of the section of vinyl siding's folded seam.

Thus has been broadly outlined the more important features of the present vinyl siding removal and installation tool so that the detailed description thereof that follows may be better understood and in order that the present contribution to the art may be better appreciated.

Objects of the present vinyl siding removal and installation tool, along with various novel features that characterize the invention are particularly pointed out in the claims forming a part of this disclosure. For better understanding of the vinyl siding removal and installation tool, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
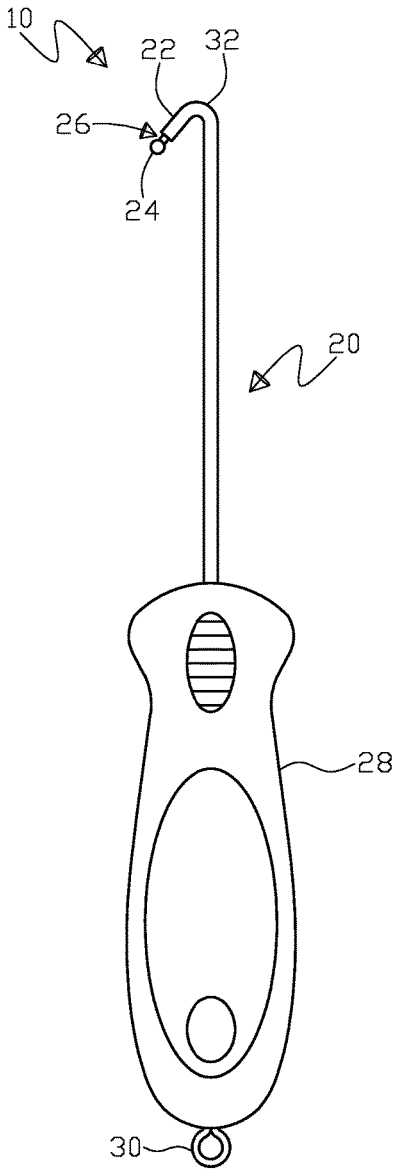
FIG. 1 is an isometric view of an example embodiment.
Figure 2:
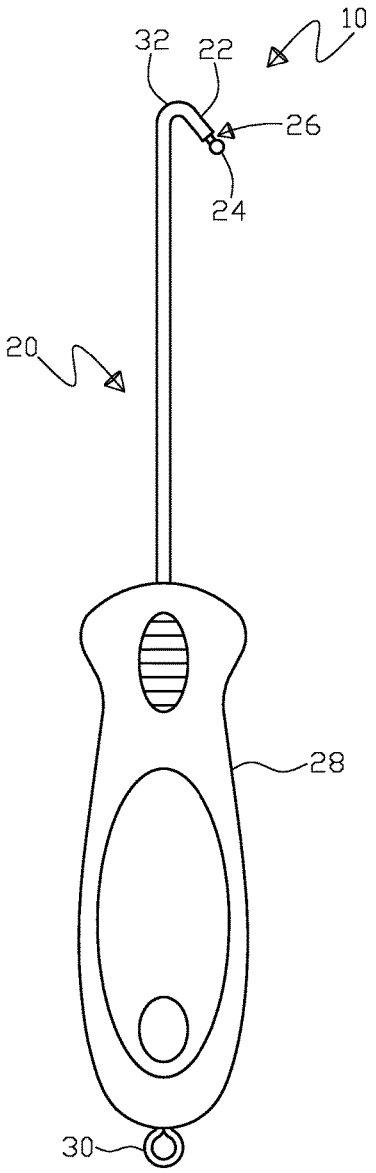
FIG. 2 is an isometric view of an example embodiment.
Figure 3:
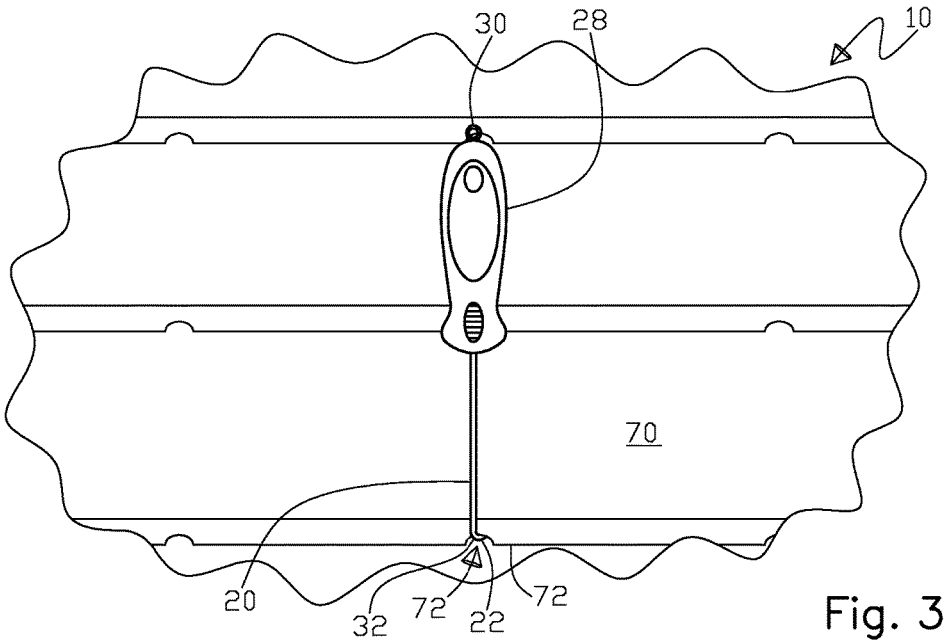
FIG. 3 is an in-use view of an example embodiment hooked into a weep hole of a section of vinyl siding whereby rotation of the tool effects uncoupling of a folded seam of said section of vinyl siding from an adjacent section of vinyl siding whereby separation along the length of said folded seam is subsequently enabled.
Figure 4:
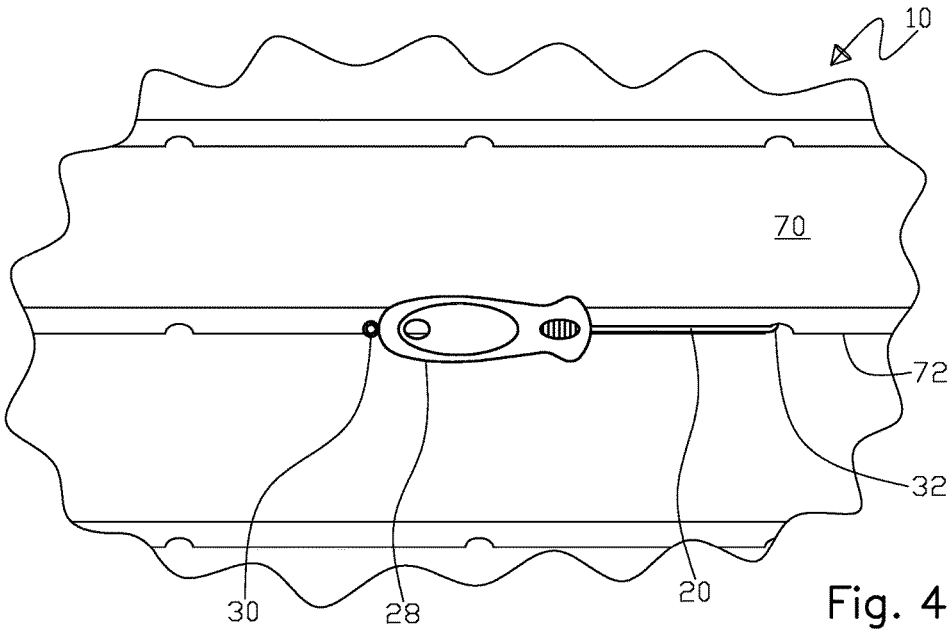
FIG. 4 is an in-use view of an example embodiment positioned into an uncoupled folded seam whereby rotation of the tool snaps the seam into coupled relation with an adjacent section of vinyl siding, whereby lateral action of the tool along the folded seam effects recoupling of said seam to the adjacent section of vinyl siding.
Figure 5:
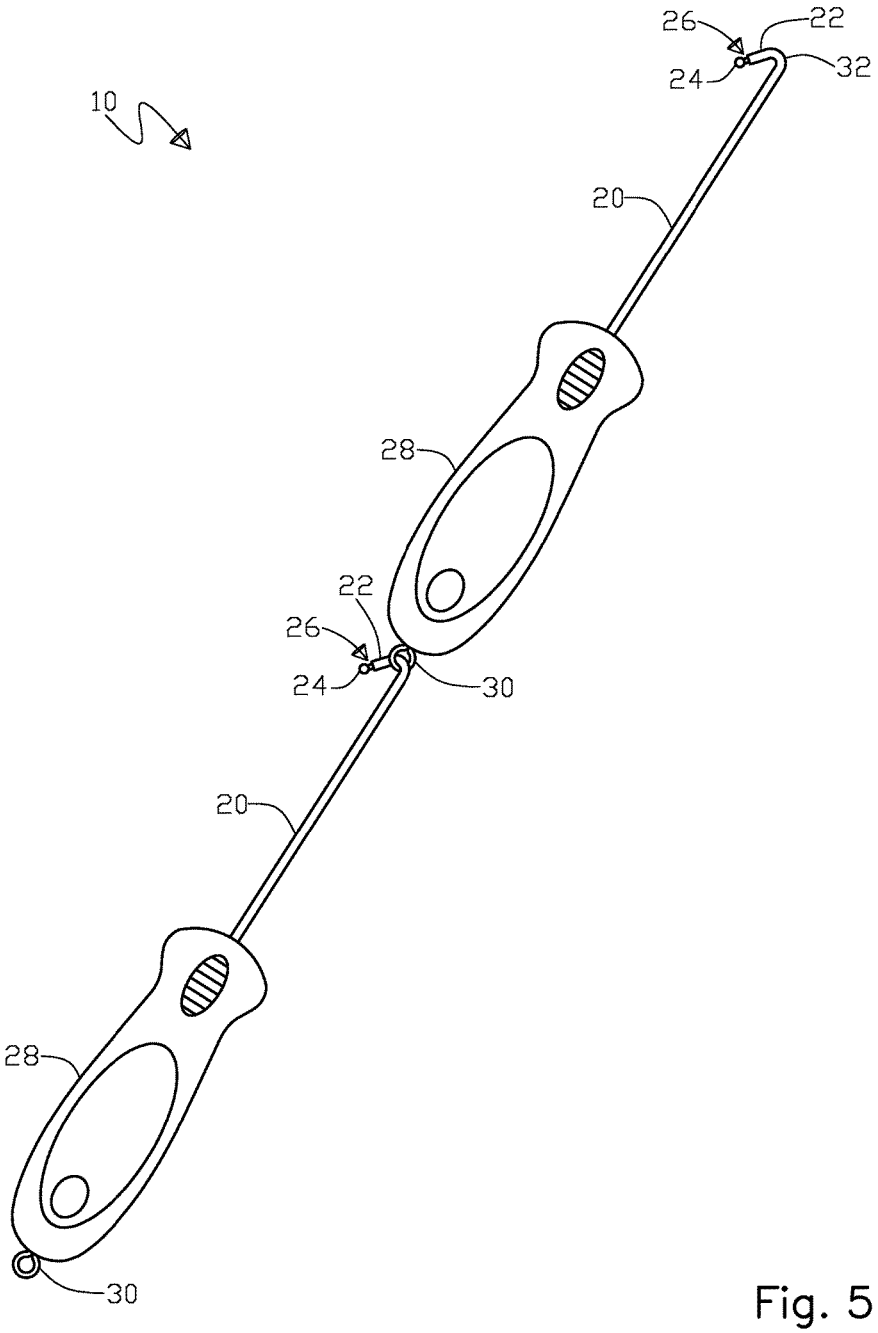
FIG. 5 is an isometric view of an example embodiment illustrating linkage of a first vinyl siding removal and installation tool to a second vinyl siding removal and installation tool by hooked engagement through an interconnection ring basally disposed endwise upon a handle.

With reference now to the drawings, and in particular FIGS. 1 through 5 thereof, example of the instant vinyl siding removal and installation tool employing the principles and concepts of the present vinyl siding removal and installation tool and generally designated by the reference number 10 will be described.

Referring to FIGS. 1 through 5 a preferred embodiment of the present vinyl siding removal and installation tool 10 is illustrated.

The present vinyl siding removal and installation tool 10 has been devised to enable an expedient means of unlocking and relocking folded seams of sections of vinyl siding, whereby insertion of a hooked end of an elongate wirelike anterior projection expeditiously unlocks and relocks folded seams of vinyl siding sections, and an interconnection ring, disposed basally upon a rubberlike handle, enables interconnecting more than one vinyl siding removal and installation tool for shared usage and extended reach when effecting relocking of a folded seam along the length of said folded seam.

The vinyl siding removal and installation tool 10, therefore, includes an elongate, wirelike anterior projection 20 having a hooked end 22 disposed for insertion into a weep hole 72 and alternately around an exposed, unlocked folded seam 74 of a section of vinyl siding 70 to alternately unlock and relock said folded seam 74, as occasion may require. The hooked end 22 includes a ball tip 24 disposed endwise upon the hooked end 22 and a groove-cut 26 disposed circumferentially proximal the ball tip 24.

A rubberlike handle 28 is disposed endwise basally upon the anterior projection 20 and an interconnection ring 30 is disposed endwise basally upon the handle 28. The interconnection ring 30 enables interconnection of the hooked end 22 of another vinyl siding removal and installation tool 10 whereby the reach of a user operating the device 10 is extended, as will be described subsequently.

The hooked end 22 is thereby insertible into any weep hole 72 disposed edgewise proximal a folded seam 74 along any section of vinyl siding 70, said hooked end 22 therein positional for manual action at the handle 28 to unlock the folded seam 74 of said section of vinyl siding 70 when a user pulls on the handle 28 down and away from said section of vinyl siding 70. Such action effects uncoupling of the folded seam 74 of a section of vinyl siding 70 from the folded seam 74 of an adjacently disposed section of vinyl siding 70 proximal the weep hole 72. The vinyl siding section 70 is thence unlocked along the length of the folded seam 74 by sliding action of the hooked end 22 along said folded seam 74, or by manual action pulling the siding section 70 away from the building to effect continuous uncoupling of the folded seam 74 along the entire length of the siding section 70, until the entire folded seam 74 is decoupled from the adjacent vinyl siding section 70.

The hooked end 22 is further insertible along an unlocked folded seam 74 of a section of vinyl siding 70, said hooked end 22 disposed to hook into the folded seam 74, and therein effect rotation by manual action at the handle 28 to reseat the folded seam 74 into engagement with an adjacent section of vinyl siding 70, and thereby effect expedient relocking of the folded seam 74 proximal the hooked end 22. Once engaged in a relocked folded seam 74, the hooked end 22 is slidable to reseat the folded seam 74 along the entire length of the section of vinyl siding 70 by sliding action of the hooked end 22 along said length of the vinyl siding 70.

When operating the device 10 from the height of a ladder, a pair of users is enabled expedient relocking of sections of vinyl siding 70 by interconnection of at least a pair of vinyl siding removal and installation tools 10. A first user effects relocking of a folded seam 74 at a proximal location, and slides the tool 10 to a farthest extremity delimited by said first user's reach. Whereupon a second user, disposed within reach of said first user's farthermost reach, interconnects the hooked end 22 of a second vinyl siding removal and installation tool 10 into the interconnection ring 30 disposed basally upon the first user's tool 10, whereby sliding action disposed to effect relocking of the seam 74 is passable to the second user who thence pulls the first user's tool 10 to continue relocking of the seam 74 along the length of the siding section 70. The first user may thence move his ladder to continue the process until the entire folded seam 74 is reseated and engaged with an adjacent section of siding 70.

Sections of vinyl siding 70 are thus expediently removable and installable by action peculiar to the instant vinyl siding removal and installation tool 10.

In an example embodiment disclosed herein the vinyl siding removal and installation tool 10 includes a rubberlike handle 28 that is 5 inches in length, an interconnection ring 30 that is 3/16 of an inch in diameter, an elongate wirelike anterior projection 20 that is 5 inches long and has a diameter of 3/32 of an inch. The hooked end 22 is 1/2 inch in length measured from an angled turn 32 in the anterior projection 20.

What is claimed is:

1. A vinyl siding removal and installation tool comprising:
an elongate wirelike anterior projection between 3 to 8 inches long, said wirelike anterior projection having:
a diameter of between 1/32 of an inch to 8/32 of an inch;
a hooked end of between 1/4 inch and 7/8 inches in length;
a ball tip disposed endwise upon the hooked end
a groove-cut circumferentially disposed upon the hooked end proximal the ball tip;
wherein the hooked end is fittable into any weep hole upon a section of vinyl siding to effect decoupling of a folded seam when the wirelike anterior projection is pulled by a user whereby said section of vinyl siding is unlockable from an adjacent section of vinyl siding and;
wherein the hooked end is fittable hooked into the folded seam of the unlocked section of vinyl siding to effect relocking of said folded seam to the adjacent section of vinyl siding by rotational action of the hooked end to reseat the folded seam locked to an adjacent section of vinyl siding whereby sliding action of the hooked end along the length of the folded seam effects relocking of said folded seam along the length of said folded seam.

2. The vinyl siding removal and installation tool of claim 1 further comprising a rubberlike handle disposed endwise basally upon the elongate wirelike anterior projection.

3. The vinyl siding removal and installation tool of claim 2 further comprising an interconnection ring disposed endwise basally upon the rubberlike handle, said interconnection ring having a diameter large enough to accommodate interconnection with a hooked end of a second vinyl siding removal and installation tool whereby at least a pair of vinyl siding removal and installation tools is interconnectable for extended reach when relocking a folded seam of a section of vinyl siding.

4. A vinyl siding removal and installation tool comprising:
an elongate wirelike anterior projection between 2 to 7 inches in length;
a hooked end between 1/4 inch and 2 inches in length, said hooked end comprising:
a ball tip disposed endwise upon the hooked end;
a groove-cut circumferentially disposed proximal the ball tip;
a rubberlike handle; and
an interconnection ring disposed endwise basally upon the handle;
wherein the hooked end is insertible into a weep hole proximal a folded seam along a section of vinyl siding, said hooked end therein positional for manual action of the handle to unlock the folded seam of said section of vinyl siding when a user pulls on the handle down and away from said section of vinyl siding, and wherein said hooked end is insertible along an unlocked folded seam of a section of vinyl siding, subsequently therein rotatable by manual action at the handle to effect expedient relocking of the folded seam proximal the hooked end, whereby sections of vinyl siding are expediently removable and installable when engaged by the hooked end, said hooked end subsequently slidable along the folded seam to continue unlocking or relocking of said folded seam.

5. A vinyl siding removal and installation tool comprising:
an elongate wirelike anterior projection;
an angled turn disposed endwise upon the wirelike projection;
a recurved hooked end disposed upon the angled turn at an acute angle relative the elongate wirelike anterior projection, said hooked end comprising:
a ball tip disposed endwise upon the hooked end;
a groove-cut circumferentially disposed proximal the ball tip;
a rubberlike handle; and
an interconnection ring disposed endwise basally upon the handle;
wherein the hooked end is insertible into a weep hole disposed edgewise proximal a folded seam along a section of vinyl siding, said hooked end therein positional for manual action of the handle to unlock the folded seam of said section of vinyl siding when a user pulls on the handle down and away from said section of vinyl siding, and wherein said hooked end is insertible along an unlocked folded seam of a section of vinyl siding, subsequently therein rotatable by manual action at the handle to effect expedient relocking of the folded seam proximal the hooked end, whereby sections of vinyl siding are expediently removable and installable when engaged by the hooked end, said hooked end subsequently slidable along the folded seam to continue unlocking or relocking of said folded seam.

6. The vinyl siding removal and installation tool of claim 5 wherein the wirelike anterior projection is at least five inches long and 3/32 of an inch in diameter.

7. The vinyl siding removal and installation tool of claim 6 wherein the hooked end is 1/2 inch in length measured from the angled turn.

8. The vinyl siding removal and installation tool of claim 7 wherein the interconnection ring has a diameter of 3/10 of an inch.

9. The vinyl siding removal and installation tool of claim 5 wherein the acute angle of the angled turn is between 40° and 47°.

* * * * *